US005108099A

United States Patent [19]

Smyth

[11] Patent Number: 5,108,099

[45] Date of Patent: Apr. 28, 1992

[54] SLOT MACHINE WITH MULTIPLE SYMBOL SELECTION

[75] Inventor: Richard E. Smyth, Kyle Bay, Australia

[73] Assignee: Ainsworth Nominees Pty Limited, Rosebery, Australia

[21] Appl. No.: 481,142

[22] Filed: Feb. 16, 1990

[51] Int. Cl.[5] ..... A63F 5/04

[52] U.S. Cl. ..... 273/138 A; 273/143 R

[58] Field of Search ..... 273/143 R, 138 A, 138 R; 364/410, 411, 412

[56] References Cited

U.S. PATENT DOCUMENTS

| | | | |
|---|---|---|---|
| 4,448,419 | 5/1984 | Telnaes | 273/143 R |
| 4,527,798 | 7/1985 | Siekierski et al. | 273/138 A |
| 4,573,681 | 3/1986 | Okada | 273/143 R |
| 4,657,256 | 4/1987 | Okada | 273/138 A |
| 4,679,143 | 7/1987 | Hagiwara | 273/138 A |
| 4,858,932 | 8/1989 | Keane | 273/143 R |

*Primary Examiner*—Edward M. Coven

*Assistant Examiner*—Jessica J. Harrison

*Attorney, Agent, or Firm*—Nikaido, Marmelstein, Murray & Oram

[57] ABSTRACT

A slot machine is provided in which the symbols or indicia to be displayed are selected by using a random number generating technique to generate a random number for each display position, the random number being selected from a range of numbers corresponding to the number of display possibilities for that position. A two step random number selection technique is used wherein the first step comprises selecting a random number from the range of numbers corresponding to the number of display possibilities for that display position, and the second step, which is only invoked in the event that a predetermined one of the range of numbers is selected in the first selection, comprises discarding the number first selected and making a further selection from the range of numbers. Accordingly, the probability of occurrence for at least one of the possible results for the display position is significantly less than that for the remainder of the possible results.

8 Claims, 7 Drawing Sheets

SLOT MACHINE WITH MULTIPLE SYMBOL SELECTION

The present invention relates generally to slot machines, otherwise known as fruit machines or poker machines, and in particular the invention provides an improved slot machine wherein the probability of winning combinations provided may be altered with regard to conventional machines without changing the number of physical symbols per reel, or alternatively that the number of physical symbols per reel may be decreased, with a consequential increase in symbol size, without altering the probability of winning combinations provided on the machine occurring.

The invention relates to slot machines common to casinos and clubs where the player inserts coins into the machine and spins the reels by handle or button whereupon they become stopped at random and if the stopped symbols coincide with the pay schedule or scorecard the player is paid a prize. If it is a multi-coin machine the player may buy extra chances or multiply potential winnings.

In particular the patent application applies to slot machines with reels, the stopping position of which is random but under the control of a microprocessor; machines of this type are described in British Patent No. 1,550,732 by P.B.R. and U.S. Pat. No. 4,095,795 by Saxton.

In a bid to attract players, casinos have offered higher and higher jackpots and as these are a percentage of revenue the chances of striking a jackpot have to be proportionally less. This was attained in the past by increasing the number of reels and increasing the number of symbols on a reel.

With the development of microprocessor controlled slot machines, where the stopping position of a reel is determined by the microprocessor, a new approach was taken. Telnaes U.S. Pat. No. 4,448,419 selected stopping positions from a virtual reel strip or memory table within the microprocessor which had more virtual positions than there were physical stop positions on the reel itself. By mapping several of these virtual positions to one of the reel symbols, the probability of the reel showing one symbol became different to that for showing others of the symbols. For example, a jackpot symbol can be made to appear with less frequency than other symbols.

With the same intention Bally's Australian Patent No. 33253/89 selects the reel stopping position from a series of random numbers divided into the same number of groups as there are reel positions; however the size of each group is unequal thereby causing the appearance of a jackpot or other symbol to be of unequal probability of appearing on a pay line.

Kabushiki Kaisha Universal also describe an arrangement in their Australian Patent No. 561873 in which the slot machine periodically checks the prize value paid by the machine over the preceding period and if this value is too high, the machine adjusts the operation of the machine to make it harder for the player to win. The Kabushiki Kaisha Universal machine is of the type where the reels are stopped under player control by the player pressing a stop button and winning is made harder by introducing a delay in the reel stopping sequence after the stop button is pressed.

The present invention consists in a slot machine having display means arranged to simultaneously display a plurality of indicia selected from a set of possible indicia and random selection means arranged to select the indicia to be displayed on said display means from said set of indicia, the indicia being divided into two or more subsets and the random selection means including first random number generation means arranged to produce one random number for each indicia display position in the display means, each said random number being selected from members of a set of random numbers each member of which corresponds with one of the possible indicia for the respective display position, the selection means performing a two step selection process wherein the first step comprises selecting a first number from said set of numbers and the second step, which is only performed when the first selected number is one of a predetermined subset of said set, comprises discarding the first selected number and making another selection from the set of numbers.

An embodiment of the present invention will now be described by way of example with reference to the accompanying drawings in which:

FIG. 1 illustrates a typical slot machine to which the present invention might be applied;

FIG. 2 schematically illustrates a first reel mapping arrangement in accordance with the present invention;

FIG. 3 schematically illustrates a conventional prior art reel mapping arrangement;

The basic principle of the present invention is to add a second step or trial when a jackpot symbol position or other nominated symbol position is about to appear on a pay line.

When the stopping of each reel is required, a random number of equal probability is selected by the microprocessor. For all but a jackpot symbol this number is mapped directly to the reel and the microprocessor stops the reel in the required position using a known technique.

In the case where the random number selected corresponds to a jackpot symbol this number is discarded and a further random selection process is called up to decide where the reel is to be stopped.

Figure 1:
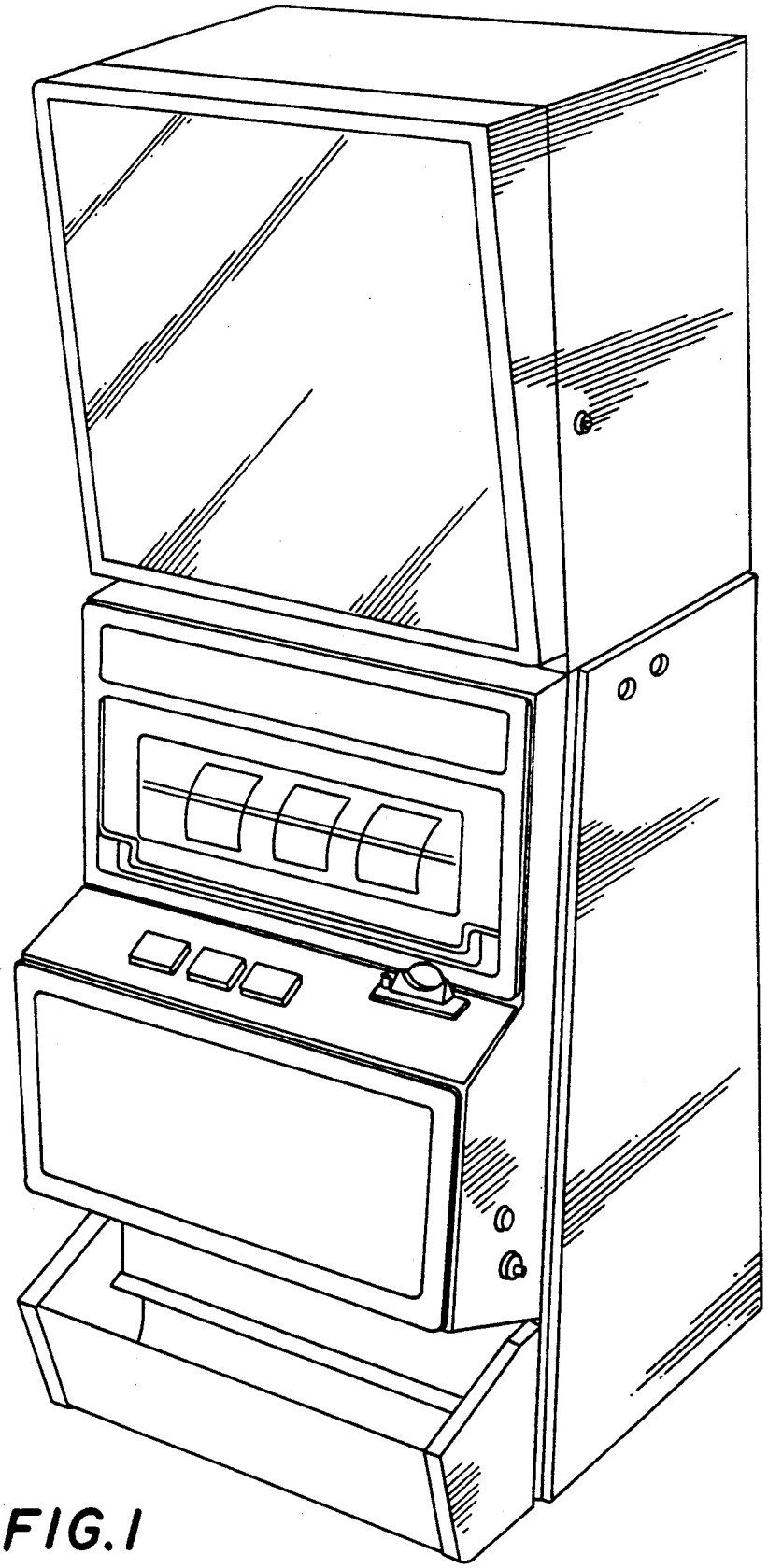
Figure 2:
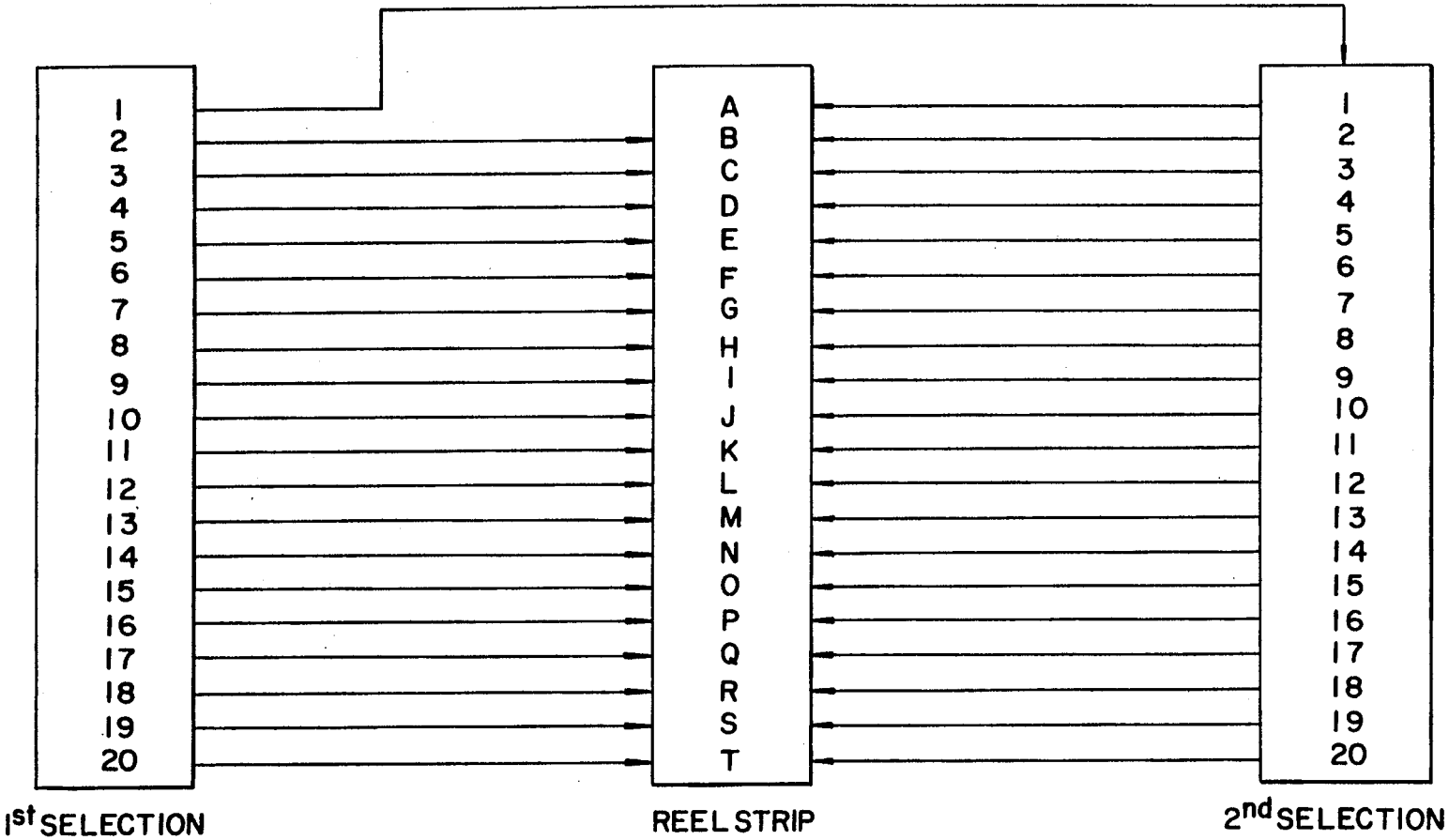
Figure 3:
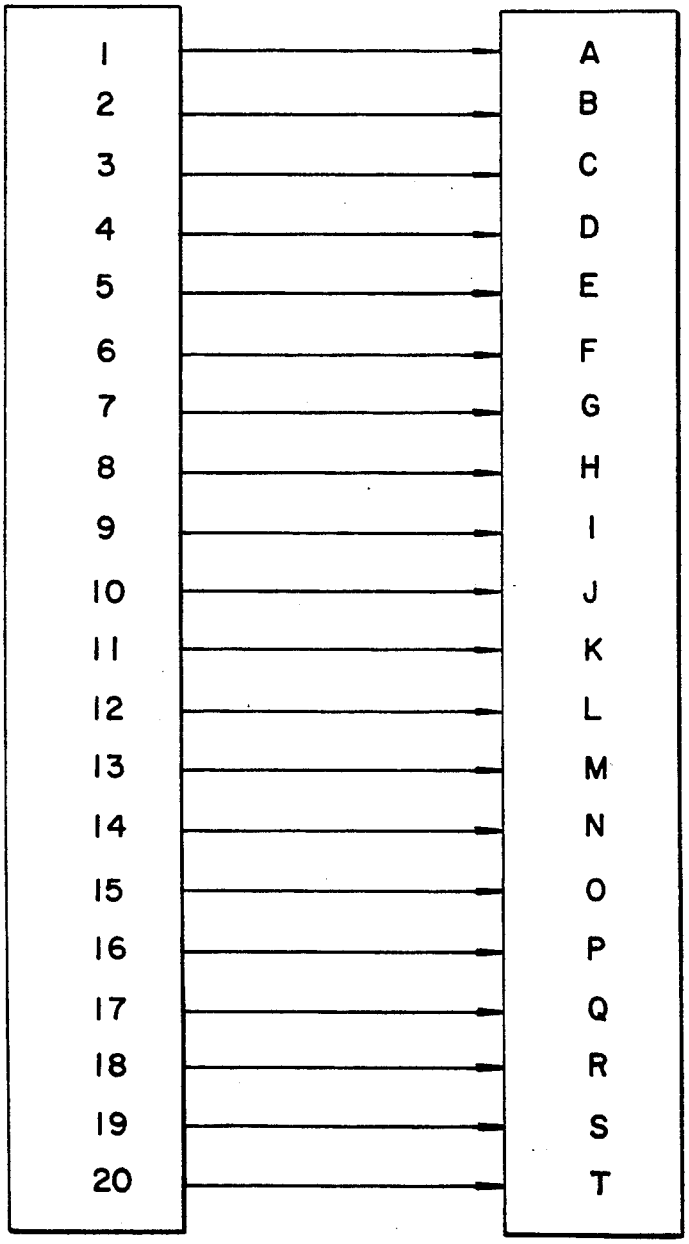
FIG. 3 PRIOR ART

FIG. 2 shows an example of a reel which has 20 stop positions. Position 'A' on the reel or reel strip is a Jackpot and has a probability of occurrence of 1/400 as opposed to 21/400 for each of the remaining symbol positions.

In this case the range of random numbers which may be selected by the first random number generating means is 1 to 20 and these are shown on the memory table or "theoretical reel strip". When random numbers 2 to 20 are chosen by the microprocessor, these are mapped direct to reel positions as shown.

When random number 1 is chosen, a second, random selection is made, again from the range of 1 to 20, and these are mapped directly onto the 20 reel strip positions.

To obtain a jackpot, a jackpot symbol is required to stop on the pay line of all reels of the slot machine and if the player fails to achieve this on the first reel to be stopped, there is no point in inhibiting this symbol on the subsequent reels. The player therefore has more encouragement and pleasure than is described in Telnaes U.S. Pat. No. 4,448,419 and Bally's 33253/89 where the frequency of jackpot symbols on the payline is always less than for other symbols.

Figure 4:
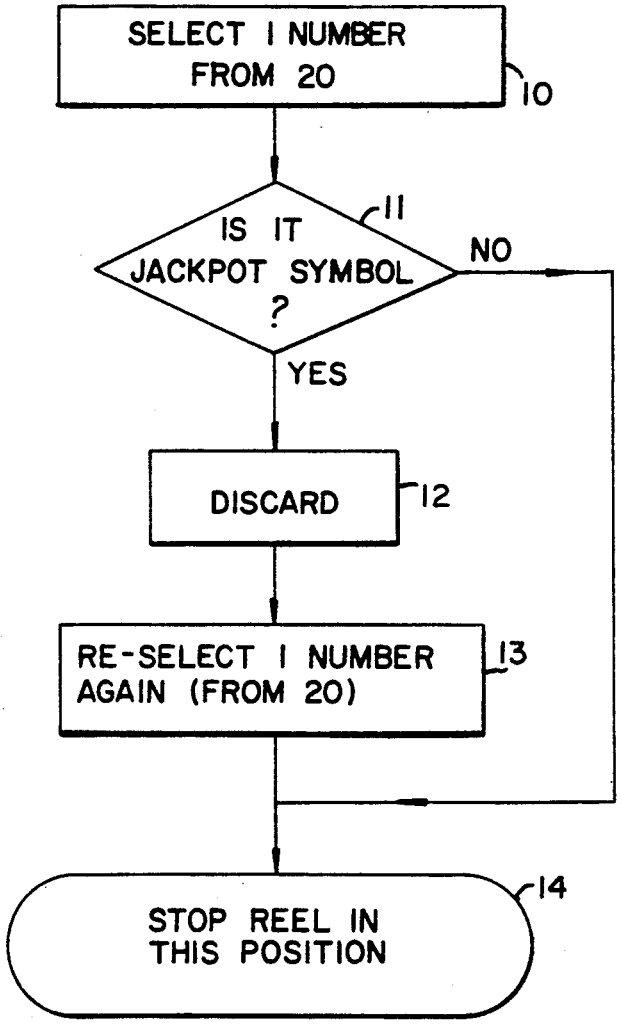
FIG. 4 illustrates a flow chart for reel control in a single jackpot embodiment of the invention making use of the mapping arrangement of FIG. 2.

Referring to FIG. 4, a first selection method in accordance with the present invention is illustrated in which a random number is selected 10 from a set of possible numbers equal in size to the number of symbol positions on the respective reel of the slot machine. The selected number is then tested 11 to see if it corresponds to a jackpot symbol and if not the reel is stopped 14 at the symbol corresponding to the selected number. However, if the first number selected does correspond to a jackpot symbol the number is disregarded 12, a new number selected 13 from the same set of numbers, and the reel is stopped 14 at the symbol corresponding to the second selected number.

Figure 5:
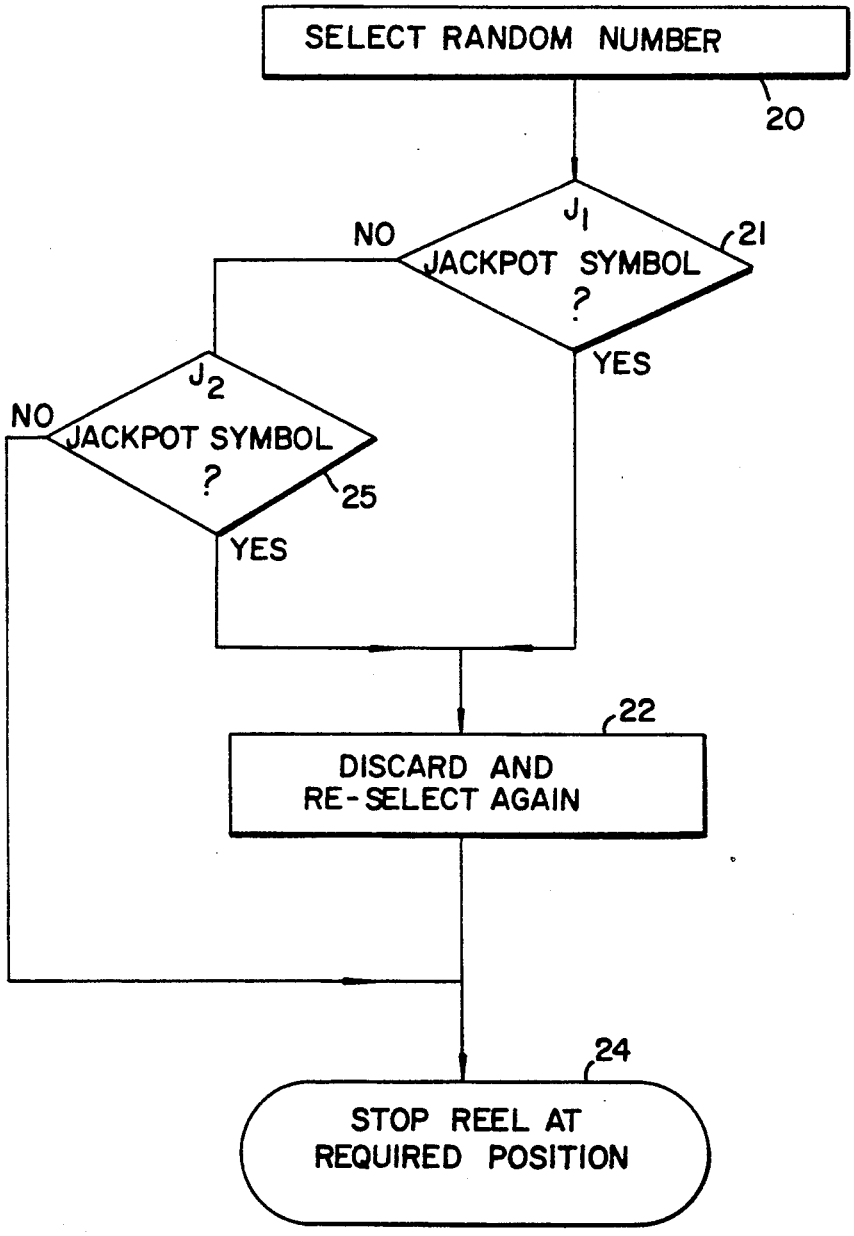
FIG. 5 illustrates a flow chart for an alternative reel control scheme providing two jackpot symbols.

A second selection method in accordance with the present invention is illustrated in the flow chart of FIG. 5. This selection method allows two different jackpot symbols to be accommodated on each reel of the slot machine and to be selected with equal probability. After a first random selection 20 is made from a set of numbers having members corresponding to the number of symbols on the respective reel, it is first tested 21 to see if it corresponds to a first jackpot symbol J1. If it does not correspond to symbol J1 the selection is tested a second time 25 to see if it corresponds to a second jackpot symbol J2 and if it does not correspond to either jackpot symbol the reel is stopped 24 at the symbol corresponding to the first random selection. If the first selection corresponds with either of the jackpot symbols J1 or J2 the selection is discarded and a further selection 22 is made from the same set of possible numbers as the first selection. The reel is then stopped 24 at the symbol corresponding to the further selection.

Figure 6:
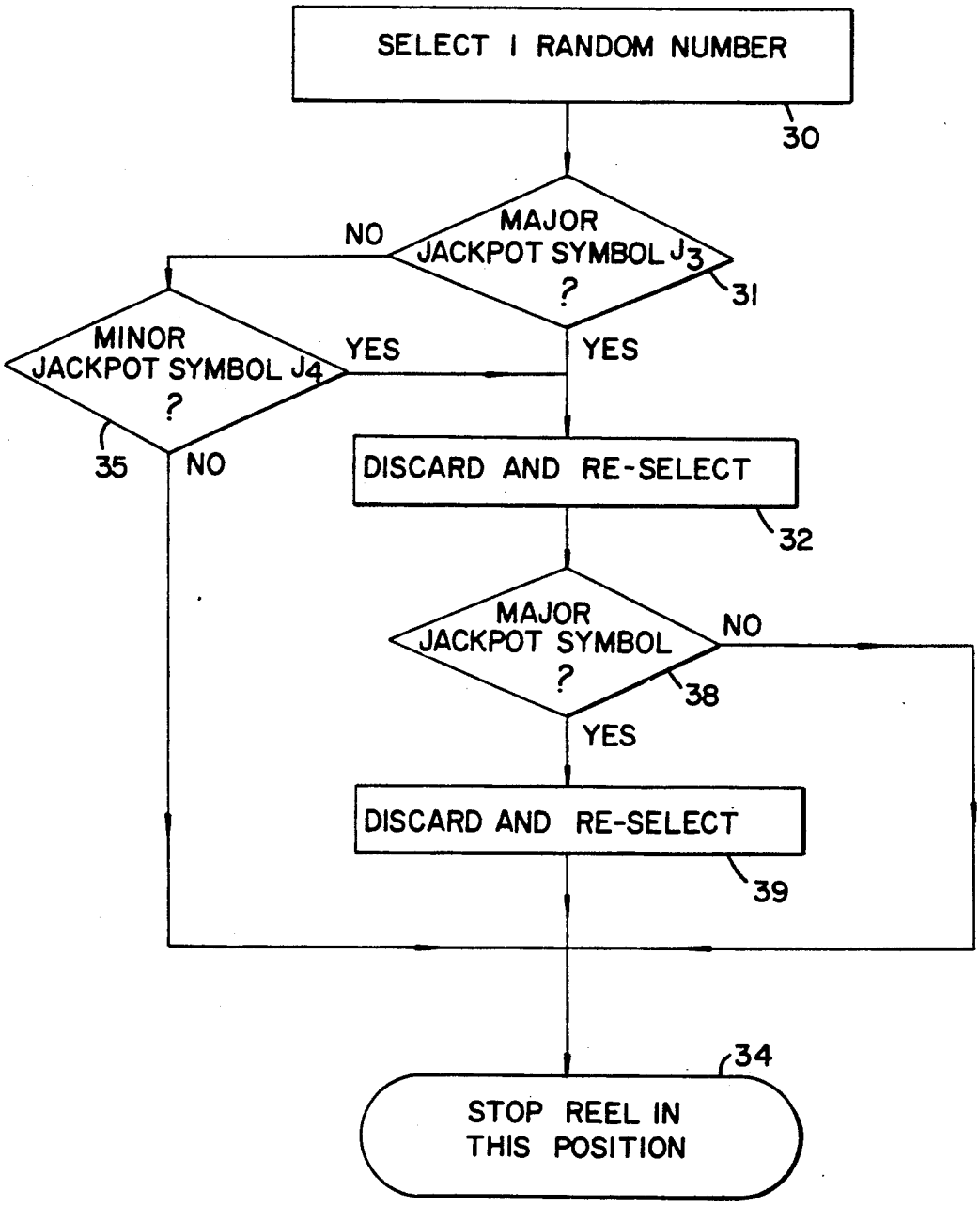
FIG. 6 illustrates a flow chart for a further alternative reel control scheme providing two jackpot symbols of unequal probability.

The flow chart of FIG. 6 illustrates yet another selection method providing for two jackpot symbols J3 and J4 on each reel with unequal probability of occurrence. With this third selection method a first random selection 30 is made from a set having the same number of members as there are symbols on the respective reels. This first selection is then tested 31 to see if it corresponds to a major jackpot symbol J3 and if not it is tested 35 for correspondence to a minor jackpot symbol J4. If the first selection does not correspond to either jackpot symbol, the reel is stopped 34 at the symbol corresponding to the first selection. If the first selection corresponds to either the minor jackpot symbol J4 or the major jackpot symbol it is discarded and a further selection made 32. The further selection is then tested 38 to see if it corresponds to the major jackpot symbol J3 and if not the reel is stopped at the symbol corresponding to the further selection. If the further selection does correspond to the major jackpot symbol J3 it is discarded and yet another selection made 39 and the reel is stopped 34 at the symbol corresponding to this final selection.

It will be noted that with the control scheme of FIG. 6 the probability of a minor jackpot symbol being displayed on the respective reel will be 1/400 while the probability of a major jackpot symbol being displayed will be 1/8000.

Figure 7:
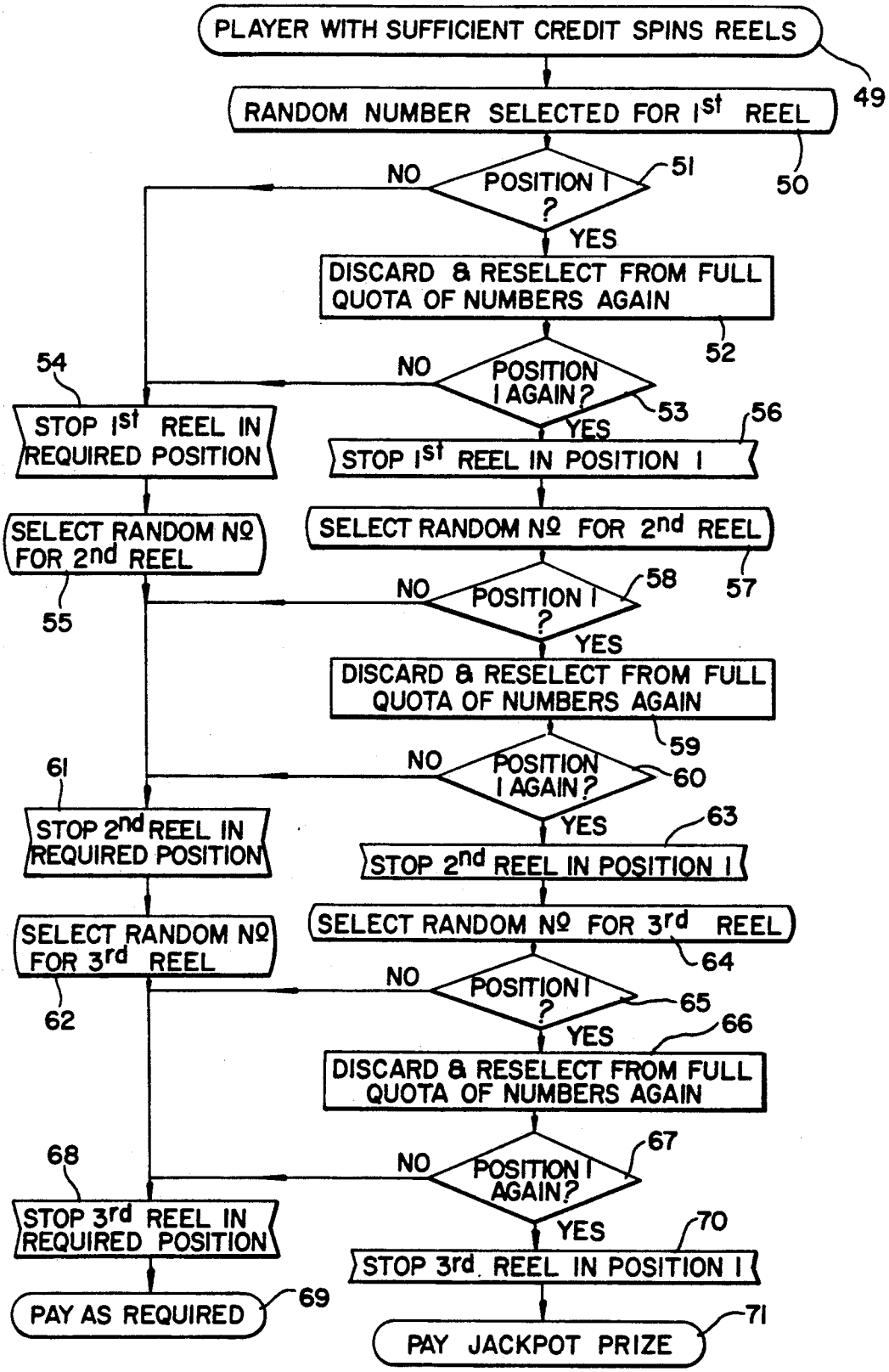
FIG. 7 illustrates a flow chart for the stopping of all reels of a three reel machine in accordance with the present invention.

The flow chart of FIG. 7 illustrates the selection process for a three reel slot machine when operated in accordance with the present invention. In this embodiment each reel is provided with a single jackpot symbol which is located in a first position on each reel of the machine.

In the scheme illustrated in FIG. 7 the reels are caused to spin 49 by a player, who has previously established a credit, operating the play switch. A random number is then selected 50 for the first reel from a set of numbers representing the sequential positions of symbols on the reel. The selected number is then tested 51 to determine if it corresponds to the first symbol (the jackpot symbol) on the reel and if not the reel is stopped 54 at the position corresponding to the selected number.

If the first number selected for the first reel does correspond to the first position the number is discarded and a new selection made 52 and this selection is tested 53 to see if it corresponds with the symbol in position 1 on the reel and if not the reel is stopped at the selected position 54 and a selection made for the second reel 55. The second reel is then stopped 61 at the selected position 61 and a selection made for the third reel 62. The third reel is then stopped at the selected position 68 and a payout made 69 as required.

In the event that the further selection for the first reel resulted in number representing position 1 the reel is stopped 56 in position 1 and a selection made 57 for the second reel. In this instance, as the first reel has stopped on the jackpot symbol the first selection for the second reel is tested 58 to see if it represents position 1 on the reel and if not the reel is stopped 61 at the selected location and a selection made 62 for the third reel which is then stopped 68 and a payout made 69 as required.

If the first reel has been stopped 56 at position 1 and the first selection 57 for the second reel is position 1, the selection is discarded and a further selection made 59 for the second reel. The further selection is again tested 60 and if position 1 is not selected the reel is stopped 61, a selection is made 62 for the third reel, the third reel is stopped 68 and a payout made as required.

If, on the other hand, position 1 is selected in the further selection for the second reel, the reel is stopped 63 at position 1 and a first selection is made 64 for the third reel. The first selection for the third reel is then tested 65 and if it does not represent position 1 the reel is stopped 68 and a payout made 69 as required.

When position 1 has been selected for reels 1 and 2 and the first selection for reel 3 is position 1, this selection is discarded and a new selection made 66 and tested 67 to see if it represents position 1. When the final selection for reel 3 is position 1 the reel is stopped in that position 70 and a jackpot payout made 71, otherwise the reel is stopped 68 in the selected position and a payout is made 69 as required.

It will be noted that the multiple selection of symbols for each reel is only carried out if the previous reels have already been stopped on jackpot symbols, and therefore if a non-jackpot symbol occurs on any reel, the probability of a jackpot symbol appearing on subsequent reels will be 1/20 for a 20 symbol reel as opposed to 1/400 when the previous reel displayed a jackpot symbol. The probability of a jackpot symbol on the first reel is always 1/400 in the embodiment of FIG. 7, however in a slightly different embodiment, the probability of the first reel displaying a jackpot symbol can be increased to 1/20 by removing steps 51 and 52 and following step 50 with step 53. In this case players will be encouraged by the more frequent occurrence of jackpot symbols on all reels but the probability of all three reels displaying a jackpot symbol in the same game would be $1/20 \times 1/400 \times 1/400 = 1/3200000$ allowing the payment of a very large jackpot prize.

The preceding mathematics and description of this invention has, for simplicity, described a slot machine with one central pay line. The invention applies equally to multi-line machines where the player can buy chances on several pay lines.

As the appearance, on the center line, of a symbol adjacent to the jackpot can give rise to a jackpot, the three consecutive symbols on a reel, such as 'A', 'B', and 'T', must be considered as a group.

The invention intends to cover such a jackpot group in the same manner as has been described for the single jackpot symbol.

I claim:

1. A slot machine comprising control means for controlling operation of the machine, display means including a plurality of display positions for displaying combinations of indicia and reward means for returning a reward to a player of the machine in response to certain predetermined indicia combinations being displayed on the display means at the end of a game, the display means including a separate indicia display means for each display position, each indicia display means being responsive to the control means to display an indicium at the end of the game which is selected by the control means from a set of possible indicia, and the control means including indicia selection means for making that selection for each of the display positions, wherein, for at least one display position, a two step selection process is employed whereby the indicia selection means comprises random number selection means for selecting a random number from a set of numbers having a one-to-one correspondence with the members of the set of possible indicia, a first step of said selection process comprising selecting a first random number from said set and the second step comprising testing the selected number and, if it corresponds to at least one predetermined one of said indicia, discarding the first selection and making another selection from the original set of numbers, and the display means being arranged to display the indicium corresponding to the number generated by the random number generation means for that position.

2. The slot machine of claim 1, wherein the two step selection process is not employed for a first of the plurality of reel positions.

3. The slot machine of claim 1, wherein the first selection is discarded if it corresponds to one of a plurality of predetermined indicia.

4. The slot machine of claim 3, wherein a third selection step is provided in the event that a second selection is made, comprising testing the second selection and, if it corresponds to one of a predetermined set of indicia, disregarding the second selection and making a third selection from the original set of numbers and displaying the indicium corresponding to the third selection.

5. The slot machine of claim 1, wherein the indicia selection means is arranged to make the selection of an indicium for at least one display position before making the selection for other display positions, and wherein, if the indicium selected for the at least one display position precludes a predetermined combination of indicia occurring on the display means, the two step selection process is not employed for the remaining display positions.

6. A method of selecting an indicium to be displayed in a display position of a slot machine display, the method comprising randomly selecting an element from a set of elements equal in number to the number of possible indicia for the display position, each said element corresponding to one of said indicia, testing the selected element for correspondence with at least one predetermined one of the indicia and in the event of such correspondence discarding the selected element and reselecting an element from said set of elements and displaying the indicium corresponding to the element selected in the respective position of the slot machine display.

7. The method of claim 6, wherein the first selected element is tested for correspondence with a plurality of predetermined indicia and discarded if any such correspondence exists.

8. The method of claim 7, wherein after the reselection step the reselected element is tested for correspondence with any of a predetermined set of indicia and if such correspondence exists the reselected element is discarded and a further reselection performed from said set of elements and the indicium corresponding to the further reselection displayed in the respective position.

* * * * *